US006439912B1

(12) United States Patent
Andric et al.

(10) Patent No.: US 6,439,912 B1
(45) Date of Patent: Aug. 27, 2002

(54) METHOD AND APPARATUS FOR LIFTING AN INTEGRATED CIRCUIT FROM A SOCKET

(75) Inventors: Anthony Andric, Lockhart; Ruel Hill, Austin; Doug Markwardt, Cedar Park, all of TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/805,869

(22) Filed: Mar. 14, 2001

(51) Int. Cl.[7] ..... H01R 13/625
(52) U.S. Cl. ..... 439/342; 439/160
(58) Field of Search ..... 439/342, 259–266, 439/267–270, 330, 331, 154, 160, 70–73

(56) References Cited

U.S. PATENT DOCUMENTS 4,840,575 A * 6/1989 Matsuoka ..... 439/267
5,482,471 A * 1/1996 Mori et al. ..... 439/263
5,688,140 A * 11/1997 McHugh et al. ..... 439/342
5,865,639 A * 2/1999 Fuchigami et al. ..... 439/330
6,004,141 A * 12/1999 Abe et al. ..... 439/73
6,224,404 B1 * 5/2001 Sauer ..... 439/160

* cited by examiner

*Primary Examiner*—P. Austin Bradley
*Assistant Examiner*—Ross Gushi
(74) *Attorney, Agent, or Firm*—Zagorin, O'Brien & Graham, LLP

(57) ABSTRACT

A lift mechanism is provided that facilitates removal of an integrated circuit from a socket. Such a socket includes a base portion and a cover that slidably engages with the base portion. An actuation device moves the cover laterally with respect to the base. A lift mechanism responds to the cover moving in a first lateral direction into an open position in which the integrated circuit can be removed from the socket, by moving at least partially in an upward direction sufficiently to displace the integrated circuit away from the socket, thereby more easily allowing the integrated circuit to be grasped and removed from the socket.

14 Claims, 5 Drawing Sheets

METHOD AND APPARATUS FOR LIFTING AN INTEGRATED CIRCUIT FROM A SOCKET

BACKGROUND OF THE INVENTION

1. Field of the Invention

This invention relates to sockets utilized in conjunction with integrated circuits and more particularly to facilitating the removal of a packaged integrated circuit from a socket.

2. Description of the Related Art

Prior art packaging techniques include packaging integrated circuits such as central processing units (CPUs) in ceramic pin grid array (PGA) packages. Such packaged CPUs were often placed in zero insertion force (ZIF) sockets on, e.g., motherboards of computer systems. ZIF sockets allow an integrated circuit in a PGA package to be placed into the socket without causing any force to be exerted on the pins of the packaged integrated circuit. Then a handle or other tool is used to cause mechanical and electrical connections to engage the pins. To remove the integrated circuit, the tool is used to mechanically and electrically disengage the pins of the PGA package from the socket, and then the integrated circuit can be removed from the ZIF socket. In the past, many PGA packages had lids, which could be grasped by user when removing the ceramic package from the ZIF socket.

Newer integrated circuits, such as newer CPUs, are frequently packaged in thin ceramic lidless packages. Such packages tend to give the user very little to grasp when trying to remove the package from the socket. In order to remove such a package, a user typically lifts one side of the package first to grasp it and in the process can bend the pins. In addition some users resort to metal tools to lift one side of the package first, which also risks damage to the pins. Therefore, it would be desirable to be able to remove the package from the socket without having to resort to lifting one side first and potentially damaging the pins.

SUMMARY OF THE INVENTION

Accordingly, a socket with a lift mechanism is provided that upwardly displaces an inserted integrated circuit to allow the integrated circuit to be more easily grasped and removed from the socket.

In one embodiment the invention provides an electrical socket for use with a packaged integrated circuit. The socket includes a base portion and a cover that slidably engages with the base portion. An actuation device moves the cover laterally with respect to the base. A lift mechanism responds to the cover moving in a first lateral direction (into an open position), by moving at least partially in an upward direction sufficiently to displace the integrated circuit away from the socket.

In an embodiment, the lift mechanism moves at least partially vertically downward in response to the cover moving in a second lateral direction (towards a closed position), to thereby prevent the lift mechanism from hindering insertion of the integrated circuit in the socket.

In an embodiment, the base portion includes a ramp, with which the lift mechanism engages when the cover is moved laterally in the first direction. Engagement with the ramp forces the lift mechanism at least partially upward so as to upwardly displace an integrated circuit inserted in the socket. The lift mechanism disengages with the ramp when the cover is moved laterally towards a closed position sufficiently to allow the lift mechanism to move at least partially in a downward vertical direction, to thereby prevent the lift mechanism from hindering insertion of the integrated circuit in the socket.

In another embodiment an electrical socket includes a base and a cover that slidably engages with the base portion. The socket includes an actuation device that moves the cover laterally with respect to the base. A spring extends from the base portion and a projection, preferably integral with the cover, engages the spring as the cover is moved laterally into a closed position to thereby prevent the spring from exerting a vertical biasing force on an integrated circuit inserted in the socket. The projection disengages from the spring when the cover is moved laterally into an open position to allow the spring to exert an upward force on an integrated circuit inserted in the socket, thereby allowing a user to grasp the integrated circuit for removal.

In another embodiment the invention provides a method for utilizing a socket that includes a base portion, and a cover that slidably engages with the base portion and moves laterally with respect to the base portion into an open and closed position. The method includes moving the cover from a closed to an open position with an actuation mechanism to allow an inserted integrated circuit to be removed from the socket. As the cover moves from the closed to the open position the integrated circuit is displaced in an upwardly vertical direction.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
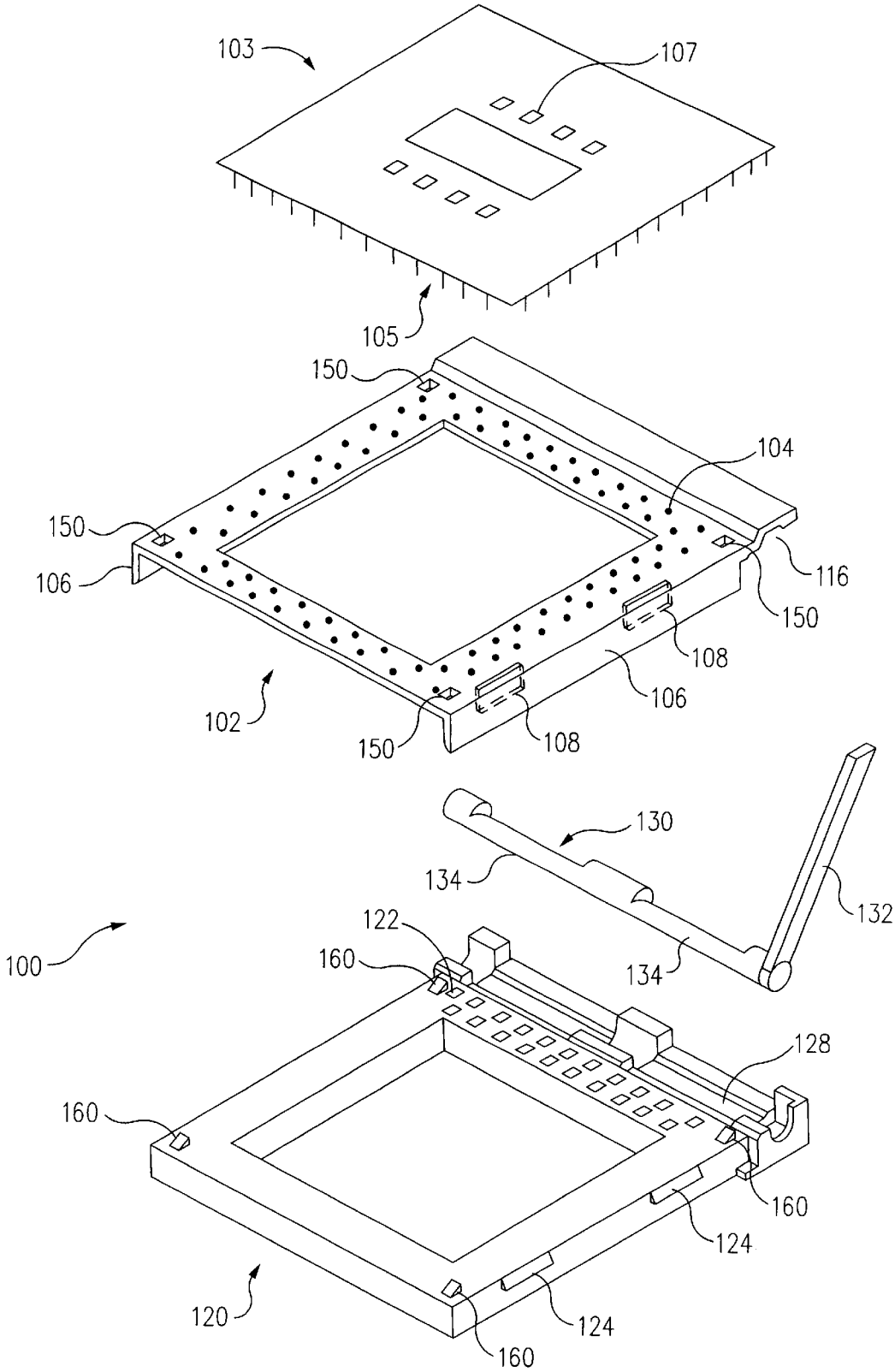
FIG. 1 shows an exploded view of an integrated circuit and a ZIF socket according to an embodiment of the invention.

A zero insertion force (ZIF) pin grid array (PGA) socket 100 and an integrated circuit 103 in a PGA package for use with the ZIF socket 100 are shown in FIG. 1. The ZIF socket 100 includes a cover 102 that has a plurality of passageways 104 therethrough. The cover 102 is slidably attached to a base 120. The base 120 includes a plurality of slots 122, which are aligned with corresponding first passageways 104. Note that the slots only on one side of base 120 are illustrated on FIG. 1. Each slot 122 includes a contact for electrical and mechanical engagement with a pin 105 of an integrated circuit 103 when the integrated circuit 103 is inserted in the socket.

The cover 102 comprises two side walls 106 extending downward from the top of the cover 102. Each side wall 106 includes openings 108 (only two openings in the near side wall shown). The base 120 forms two protrusions 124 on each of its side walls which are received by the corresponding openings 108 of each side wall 106 of the cover 102 in order to secure the cover 102 to the base 120.

The cover has a recessed portion 116 formed underneath the top surface of the cover 102. The base has a second recessed portion 128 which corresponds to the recessed portion 116 in cover 102. An actuation device 130 moves the cover with respect to the base, and is disposed between the recessed portion 116 of the cover 102 and the recessed portion 128 in base 120. The actuation device may utilize a handle 132 as shown or may be actuated with a tool such as a screwdriver. Cam sections 134 are used to engage the cover 102 and cause it to move laterally with respect to the base 120 as the actuation mechanism 130 is rotated in recessed portions 128 and 116.

The pins 105 of packaged integrated circuit 103 are inserted through passageways 104 into the slots 122 (slots on only one side shown). With the handle 132 in the vertical position, the cover is in an open position allowing the PGA package 103 to be inserted or withdrawn from the socket 100. As the actuation mechanism is closed by rotating the handle 132, the cover moves laterally resulting in the pins being electrically and mechanically coupled to the socket 100.

In one embodiment a socket according to the present invention includes lifts 150. As the cover 102 slides from a closed to an open position in response to the actuation mechanism rotating, which allows the packaged integrated circuit 103 to be withdrawn from the socket, the lifts 150 on cover 102 engage with corresponding ramps 160 on base 120. The lifts 150 may be formed integrally with the cover 102 of a thin plastic material and should be sufficiently flexible to bend upward as they engage with ramps 160. As the cover 102 slides into an open position, the ramps 160 force the lifts 150 upwards which in turn cause the integrated circuit 103 to be displaced upward. Note that in order to minimize any possible damage to pins, the upward force on the integrated circuit 103 from lifts 150 should not occur until the pins have been released by the movement of cover 102 so they can be removed from the socket with minimum friction. As the package is displaced upwardly, it can be grasped by the user and extracted from the socket without having to lift one side of the integrated circuit first and therefore there is less risk of bending the pins. The upward displacement required to make integrated circuit 103 graspable is small, e.g., on the order of 1/32 to 1/16 of an inch of elevation. Thus, the amount of upward displacement required of lifts 150 is also small.

In order to insert an integrated circuit into a socket according to the present invention, the integrated circuit can be inserted in the socket 130 when the lifts are in an upward position. A slight force exerted by the user can be used to cause the lifts to be retracted back so there is no upward displacement of the integrated circuit 103 and the cover 102 can be rotated into a closed position electrically and mechanically coupling the pins 105 of the integrated circuit 103 into the socket 100.

In addition, rotation of the actuation mechanism can be used to cause the lifts to be moved vertically downward below the level at which they hinder insertion of the integrated circuit 103. With the lifts no longer interfering, the integrated circuit 103 seats all the way down into slots 122 and as the actuation mechanism continues to rotate, with the lifts 150 out of the way, the pins 105 of integrated circuit 103 can be secured in socket 100.

In one preferred embodiment, the initial part of the rotation of actuation mechanism 130 can be used to move the lifts out of the way with the remaining part of the rotation being used to secure the pins 103 into slots 122.

Figure 2:
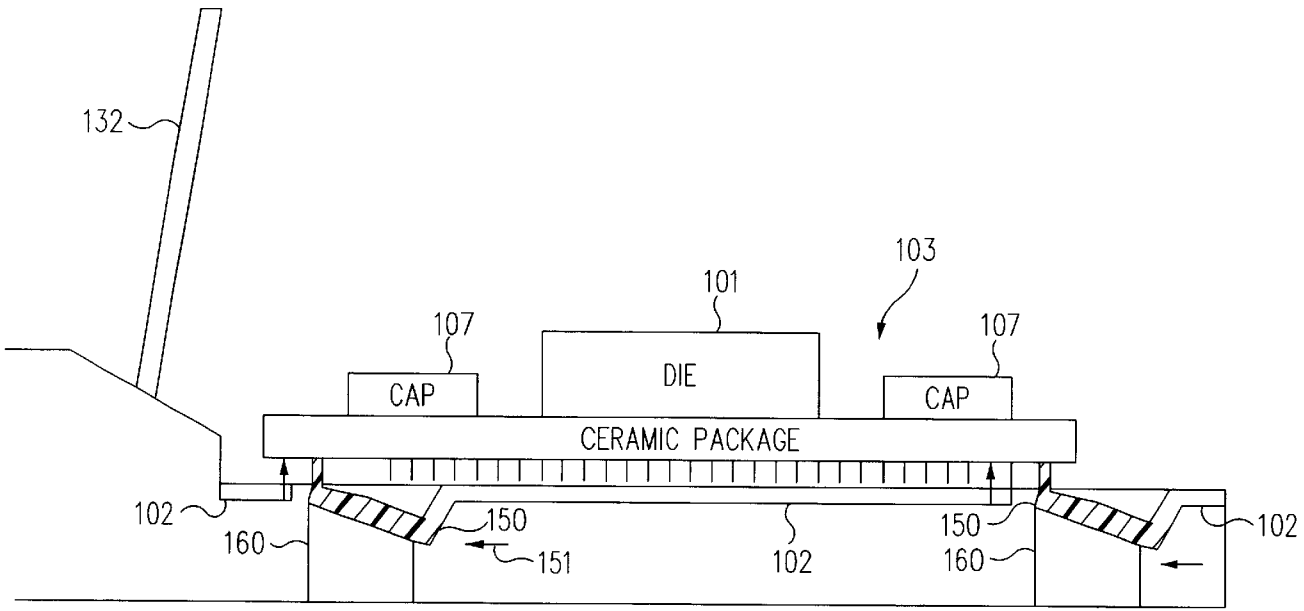
FIGS. 2–5 show various cross sectional views of the lift mechanism.
Figure 3:
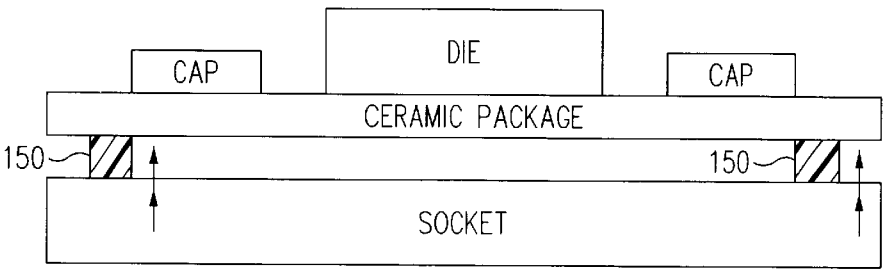

Referring to FIG. 2, a side view of an embodiment of the present invention is shown. The ramps 160 and lifts 150 are shown exaggerated in FIG. 2 in order to more clearly explain operation of an embodiment of the invention. The packaged integrated circuit 103 includes integrated circuit die 101, which may for example be processor, as well as capacitors 107 disposed on the top side of the illustrated PGA package. As the lifts 150, which form part of the cover 102 move in the direction of the arrow 151 (the cover moving into an open position) the lifts 150 can be seen to be vertically displacing the packaged integrated circuit 103 away from the socket as a result of ramps 160 engaging the lifts 150. FIG. 3 shows another view of the lifts 150 displacing the integrated circuit 103 into a graspable position.

Figure 4:
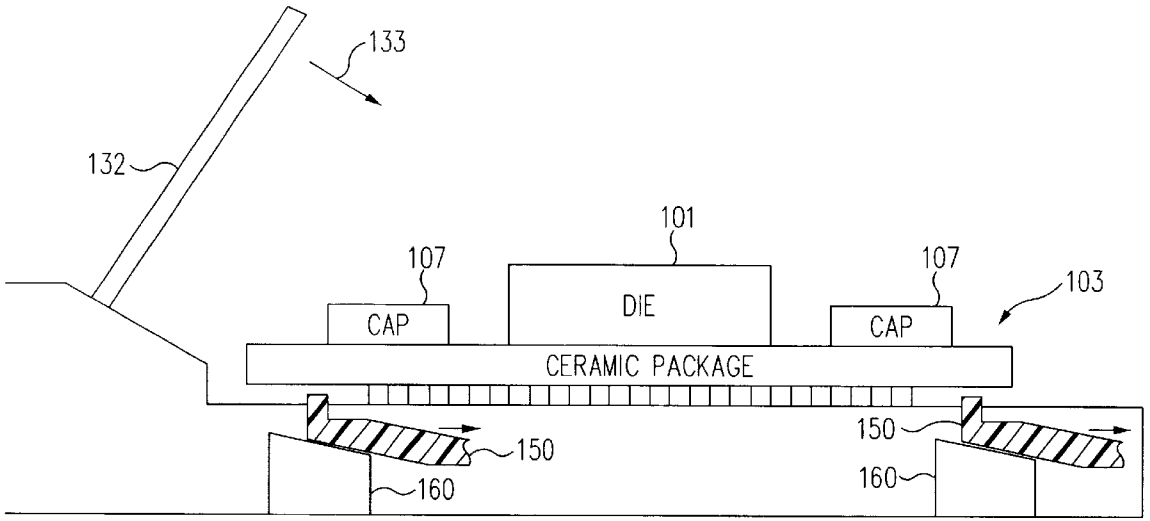
Figure 5:
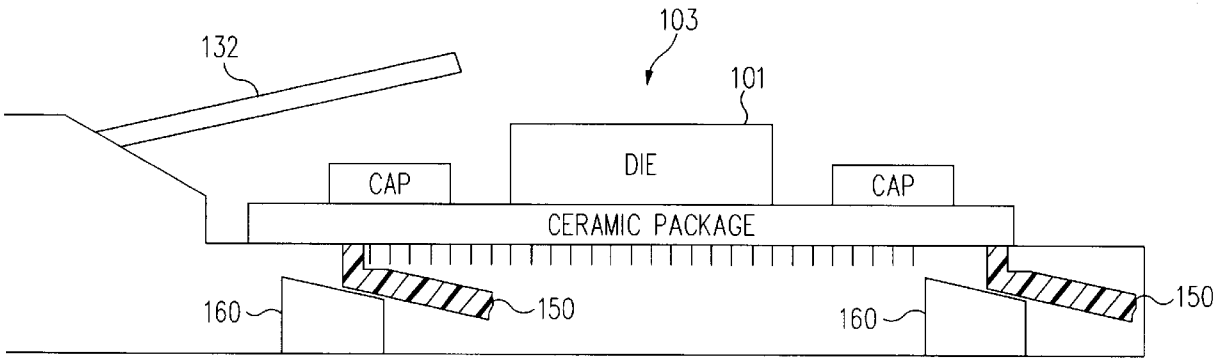

FIG. 4 and 5 illustrate operation of the lifts 150 and ramps 160 as the cover (not shown) is moved into a closed position. As the actuation mechanism begins to rotate in response to movement of handle 132 in the direction of the arrow 133, lifts 150 slide down ramps 160. When the handle 132 is fully rotated into a closed position, the lifts 150 are completely out of the way and do not hinder the coupling of pins 105 into socket 100.

Note that the lifts 150 and ramps 160 are shown disposed in the corners of the cover 102 and base 120 in FIG. 1. However, the lifts and ramps could be disposed anywhere that is convenient to cause the integrated circuit to be lifted upwards when the cover is moved into an open position, e.g., on the inside corners of the cover 102 and base 120. The particular location used depends on the socket. Note also that while this invention has been described with particular reference to a ZIF socket it can be used for other types of sockets such as low insertion force sockets and any other sockets which would benefit from being able to grasp the inserted integrated circuit for removal from the socket.

Figure 6:
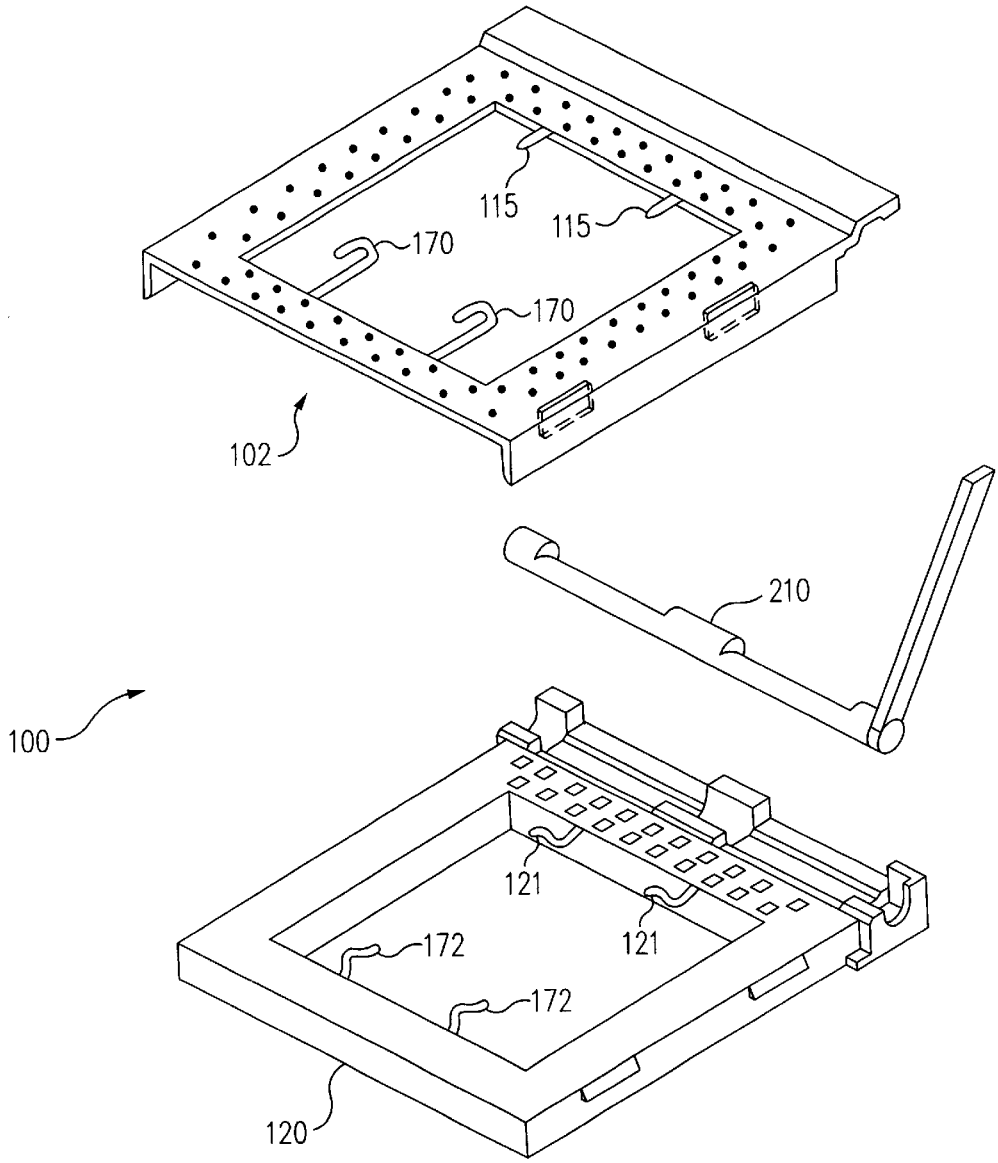
FIG. 6 shows an exploded view of a ZIF socket according to another embodiment of the invention.

Referring to FIG. 6, another embodiment of the present invention is illustrated. Base member 120 includes springs 121 and 172 which exert an upward force on an integrated circuit when it is inserted in socket 100 and the cover is in an open position. The shape and position of projections 115 and 170, and springs 121 and 172, are exemplary. Other positions and shapes for the projections and springs are possible. As the cover 102 is moved laterally into the closed position by rotating the actuation mechanism, projections 115 and 170, respectively, engage the springs 121 and 172 and force them out of the way of the integrated circuit 103 allowing its pins to fully seat in passageways 122.

Figure 7:
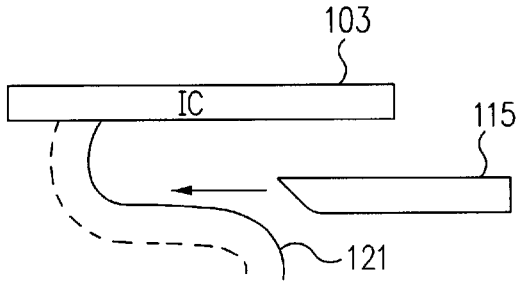
FIG. 7 shows a detailed view of the spring mechanism and projecting member shown in FIG. 6.

Referring to FIG. 7, the spring 121 and projections 115 are shown in greater detail. As the projection, which is preferably integrally formed with cover 102 engages the spring, the spring is forced down to the position indicated by the dotted lines, and the spring no longer hinders insertion of integrated circuit 103 in socket 100. As the cover 102 is moved laterally into an open position, the projection 115 disengages from spring 121 to allow the spring 121 to exert an upward force on integrated circuit 103, allowing the integrated circuit to be grasped for removal from socket 100. The spring should preferably not exert any force on the integrated circuit 103 until the pins of the integrated circuit are substantially free from any restraining force exerted by the socket. Thus, the spring should not be allowed to engage the integrated circuit until after the cover moves laterally sufficiently towards an open position to remove those forces electrically and mechanically coupling the pins in socket 100. Similarly, on closing the cover by moving it laterally towards the closed position by rotating actuation mechanism 130, the initial movement of the actuation mechanism 130 should cause the projection 115 to engage the spring sufficiently to prevent the spring from exerting an upward force on integrated circuit 103, thereby allowing the integrated circuit pins to be fully seated in slots 122.

Note that there are preferably a sufficient number of springs to cause the integrated circuit 103 to be forced upwards evenly to avoid stress on the pins of the integrated circuit.

Figure 8:
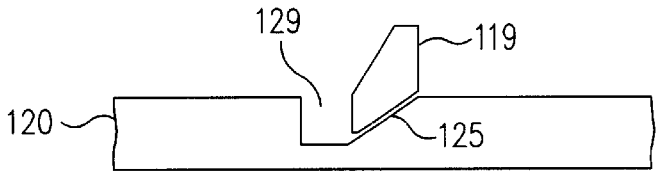
FIG. 8 shows a detailed view of a ramp and lift mechanism according to an embodiment of the invention.

Referring to FIG. 8, another embodiment of the invention is shown in which base 120 includes a recess portion 129 into which lift 119 slides as the cover (not shown) is moved laterally into a closed position. Lift 119 is preferably formed integrally with cover 102. As the cover is moved laterally towards the open position, the force exerted by base 120 on lift 119 causes it to be displaced vertically upward as it is moved laterally along the incline 125, thereby displacing an integrated circuit inserted in the socket.

Figure 9:
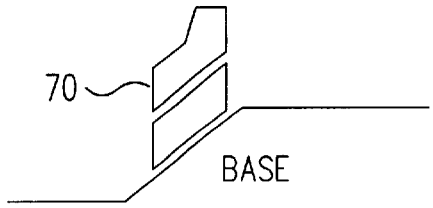
FIG. 9 shows a detailed view of a lift mechanism in which one part of the lift mechanism is floating.

Referring to FIG. 9, if additional vertical displacement is desired, it can be obtained by using a free floating element 70 which floats on top of lift portion 72, which is preferably formed integrally with cover 102. That allows, e.g., a 2X displacement by using free floating element 70. Free floating element 70 should be sufficiently secured to lift portion 72 to be held in place during lateral motion of cover 102.

Thus, a method and apparatus for more easily removing an integrated circuit from a socket has been described. The description of the invention set forth herein is illustrative, and is not intended to limit the scope of the invention as set forth in the following claims. For example, while the application has specifically mentioned PGAs, the invention may also be utilized with other packaging technologies such as micro PGAs and interstitial PGA packaging. Variations and modifications of the embodiments disclosed herein, may be made based on the description set forth herein, without departing from the scope and spirit of the invention as set forth in the following claims.

What is claimed is:

1. An electrical socket for use with a packaged integrated circuit, comprising:

a base portion having a ramp portion disposed on its top surface;

a cover slidably engaged with the base portion;

an actuation device coupled to move the cover laterally with respect to the base; and at least one flexible lift mechanism integral with the cover and responsive to the cover moving in a first lateral direction, to bend at least partially in an upward direction sufficiently to engage and displace the packaged integrated circuit away from the socket, the first lateral direction being into an open position.

2. The electrical socket as recited in claim 1 wherein the electrical socket includes a plurality of lift mechanisms to displace the integrated circuit vertically without causing stress to pins.

3. The electrical socket as recited in claim 1 wherein the lift mechanism bends at least partially vertically downward in response to the cover moving in a second lateral direction, to thereby prevent the lift mechanism from blocking insertion of the integrated circuit in the socket.

4. The electrical socket as recited in claim 1 wherein the lift mechanism is retracted completely during an initial part of movement of the actuation device to move the cover into a closed position prior to mechanically and electrically coupling pins of the integrated circuit to the socket.

5. The electrical socket as recited in claim 1 wherein the lift mechanism disengages at least partially with the ramp portion when the cover is moved laterally in a second direction, the second direction being towards a closed position, so as to allow the lift mechanism to move at least partially in a downward vertical direction, to thereby prevent the lift mechanism from hindering insertion of the integrated circuit in the socket.

6. The electrical socket as recited in claim 1 wherein the socket is a zero insertion force (ZIF) socket.

7. An electrical socket for receiving an integrated circuit, comprising:

a base portion;

a cover slidably engaged with the base portion;

an actuation device coupled to move the cover laterally with respect to the base;

at least one spring extending from the base portion;

at least one projecting member responsive to the cover being moved laterally into a closed position to engage the spring to thereby prevent the spring from exerting a force on an integrated circuit inserted in the socket; and wherein the projecting member is responsive to the cover being moved laterally into an open position to disengage from the spring so the spring exerts an upward force on an integrated circuit inserted in the socket, thereby allowing a user to grasp the integrated circuit for removal.

8. The electrical socket as recited in claim 1 wherein the projecting member is formed integrally with the cover.

9. The electrical socket as recited in claim 7 wherein the socket is a zero section force (ZIF) socket.

10. A method for utilizing a socket that includes a base portion, and a cover slidably engaged with the base portion that moves laterally with respect to the base portion into an open and closed position, the method comprising:

moving the cover from a closed to an open position with an actuation mechanism to allow an inserted integrated circuit to be removed from the socket; and forcing a flexible lift mechanism to bend upward as the lift mechanism engages a ramp formed on the surface of the base portion as the cover moves from the closed to the open position, thereby displacing the integrated circuit in an upwardly vertical direction in response to the cover moving towards the open position.

11. A method for utilizing a socket that includes a base portion, and a cover slidably engaged with the base portion that moves laterally with respect to the base portion into an open and closed position, the method comprising:

moving the cover from a closed to an open position with an actuation mechanism to allow an inserted integrated circuit to be removed from the socket;

displacing the integrated circuit in an upwardly vertical direction in response to the cover moving towards the open position and wherein the integrated circuit is displaced in an upwardly vertical direction by at least one spring coupled to the base, as the cover moves towards the open position.

12. The method as recited in claim 11 further comprising engaging the spring with a projecting member as the cover is moved laterally into a closed position to thereby prevent the spring from exerting a vertical force on an integrated circuit inserted in the socket.

13. A socket for receiving an integrated circuit comprising:

a base portion;

a cover slidably engaged with the base portion for movement in a first and second lateral direction; and means for displacing the integrated circuit received into the socket in an upward direction in response to the cover moving in a first lateral direction towards an open position, the open position allowing the integrated circuit to be removed from the socket, the means for displacing including a means formed integrally with the cover, for bending upward in response to the cover being moved in the first lateral direction, thereby displacing the integrated circuit.

14. The socket as recited in claim 13 further wherein the means for displacing the integrated circuit moves at least partially in a downward vertical direction, to prevent the means for displacing from hindering insertion of the integrated circuit in the socket, as the cover moves laterally into a closed position to electrically and mechanically secure the integrated circuit into the socket.

* * * * *